US006579212B2

(12) United States Patent
Panatta

(10) Patent No.: US 6,579,212 B2
(45) Date of Patent: Jun. 17, 2003

(54) POSTURE TRAINING MACHINE

(75) Inventor: Rodolfo Panatta, Apiro (IT)

(73) Assignee: Panatta Sport S.r.l., Apiro (IT)

( * ) Notice: Subject to any disclaimer, the term of this patent is extended or adjusted under 35 U.S.C. 154(b) by 0 days.

(21) Appl. No.: 09/817,746

(22) Filed: Mar. 26, 2001

(65) Prior Publication Data

US 2002/0002104 A1 Jan. 3, 2002

(30) Foreign Application Priority Data

Jun. 6, 2000 (IT) ..... B02000A0338

(51) Int. Cl.[7] ..... A63B 71/00
(52) U.S. Cl. ..... 482/93; 482/8; 482/9
(58) Field of Search ..... 482/3, 5, 6, 8, 482/9, 91, 93, 900–902

(56) References Cited

U.S. PATENT DOCUMENTS 4,493,485 A 1/1985 Jones
4,712,791 A * 12/1987 Edward ..... 482/112
4,743,009 A * 5/1988 Beale ..... 482/901
5,356,353 A 10/1994 Takaoka ..... 482/9
5,830,162 A * 11/1998 Giovannetti ..... 482/69
6,132,347 A * 10/2000 Alessandri ..... 482/13

FOREIGN PATENT DOCUMENTS

EP 0993845 4/2000
FR 2490949 4/1982

* cited by examiner

*Primary Examiner*—Glenn E. Richmon
(74) *Attorney, Agent, or Firm*—Ladas & Parry

(57) ABSTRACT

The machine provides for training a user in maintaining a correct posture when performing a physical exercise, and has a frame resting on the floor and which supports a number of exercise devices and a supporting surface for supporting part of the user's body. The main characteristic of the present invention lies in the machine having means for detecting a correct posture of the user and which are fitted to the supporting surface.

12 Claims, 2 Drawing Sheets

POSTURE TRAINING MACHINE

The present invention relates to a posture training machine.

BACKGROUND OF THE INVENTION

As is known, the shortage of open spaces, intensive study, the widespread use of computers, and long hours in front of a television have led, particularly in children, to various motor deficiencies. When deprived of physical exercise, a child's psychomotor development is impaired, which eventually results in various forms of paramorphism. The most common affect the musculoskeletal system, as in scoliosis or lateral curvature of the spine, others affect other areas such as the cardiocirculatory and respiratory systems, and all have a potentially negative effect on the psychological behaviour of the child.

SUMMARY OF THE INVENTION

It is an object of the present invention to provide a machine for training a user, in particular a child, to maintain a correct posture designed to promote correct physical development.

According to the present invention, there is provided a machine for training a user to maintain a correct posture and comprising a frame resting on the floor and in turn comprising at least one exercise device and supporting means for supporting part of the user's body; the machine being characterized by comprising detecting means for detecting the correct posture of the user; said detecting means being fitted to said supporting means.

BRIEF DESCRIPTION OF THE DRAWINGS

A preferred, non-limiting embodiment of the invention will be described by way of example with reference to the accompanying drawings, in which.

DETAILED DESCRIPTION OF THE INVENTION

Figure 1:
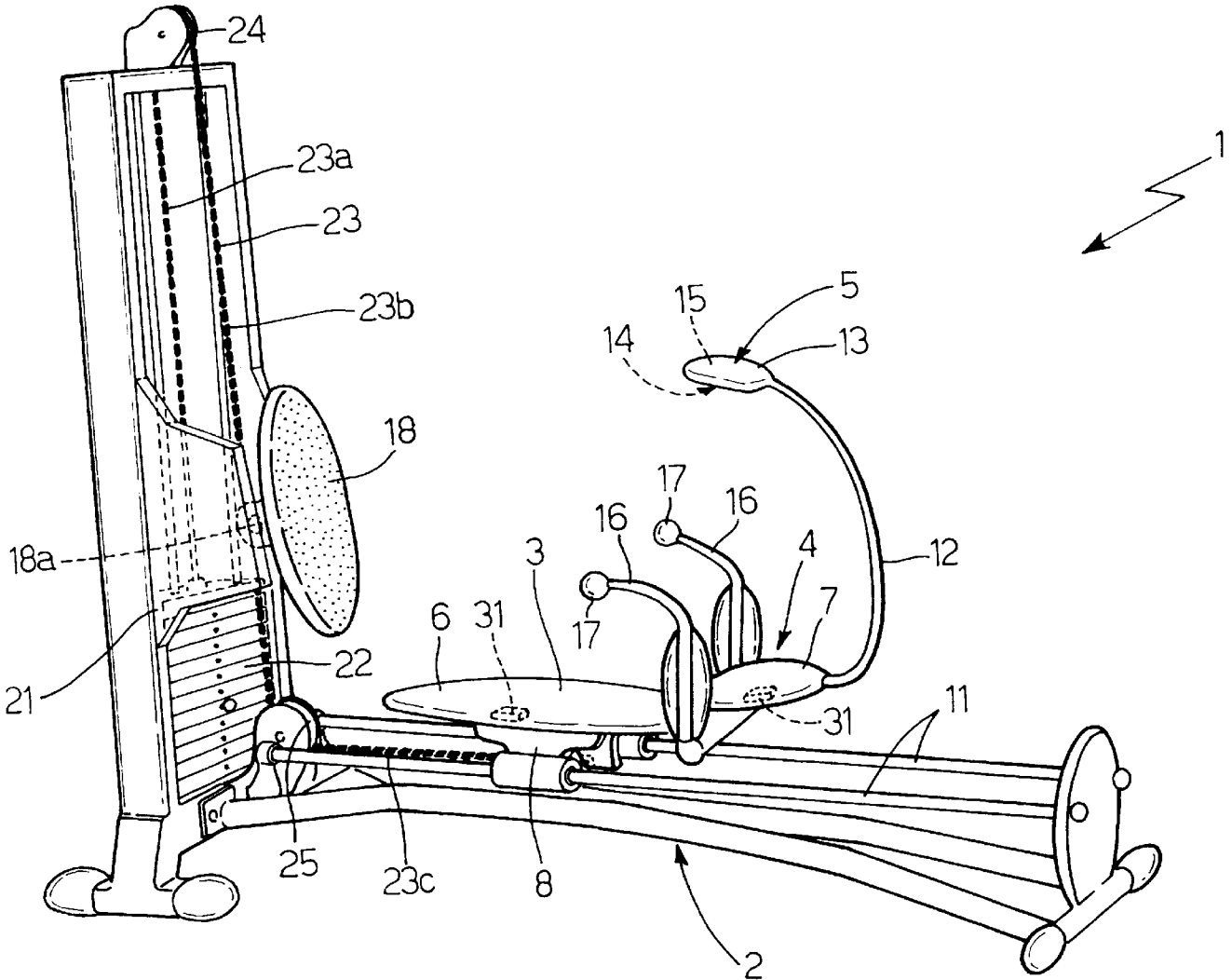
FIG. 1 shows a view in perspective of a machine in accordance with the teachings of the present invention.

Number 1 in FIG. 1 indicates as a whole a machine for training a user, in particular a child, to maintain a correct posture before and during simple physical exercises. Machine 1 comprises a frame 2 resting on the floor and in turn comprising a number of exercise devices. Frame 2 supports a substantially horizontal supporting surface 3 for supporting the back of the child (not shown); correct-posture detecting means 4; and correct-posture signaling means 5.

With reference to FIG. 1, supporting surface 3 comprises a backrest plate 6; a headrest 7; and a shuttle 8 supporting plate 6 and headrest 7 and running along a horizontal guide 11 carried by frame 2. Supporting surface 3 supports an arm 12, which extends from headrest 7, is fitted on the free end with a box-shaped body 13, and is so formed that one face of box-shaped body 13 faces headrest 7. The same face of box-shaped body 13 is fitted with a display 14 (FIG. 3); an electronic central control unit 15 (FIG. 2) detects the necessary data and supplies it to display 14 (FIG. 2), which, facing headrest 7, is clearly visible by the child; and, as shown in FIG. 1, central electronic control unit 15 is advantageously, though not necessarily, housed inside box-shaped body 13.

With reference to FIG. 1, supporting surface 3 has two vertical arms 16, each having a substantially horizontal grip 17. Machine 1 comprises an exercise device in turn comprising a footboard 18 carried by a vertical portion 21 formed at a first axial end of frame 2, and a number of weights 22 carried by portion 21 and connected to shuttle 8 by a tie 23. The number of weights 22 connected by tie 23 to shuttle 8 is selectable in known manner. Tie 23 comprises a first vertical portion 23*a* extending upwards from weights 22 and about a first pulley 24 carried by portion 21; a second vertical portion 23*b* extending downwards from pulley 24 and about a second pulley 25 carried by frame 2 at the bottom end of supporting surface 3; and a third horizontal portion 23*c* connected to shuttle 8. In actual use, from a contracted position in which shuttle 8 is close to portion 21, the child pushes its feet firmly against footboard 18 to extend its legs in opposition to weights 22, which tend to maintain the above position of shuttle 8, so as to push shuttle 8 away from portion 21. For more correct use of the above second exercise device, footboard 18 is preferably formed to so as to rock about a horizontal pin 18*a*.

Figure 2:
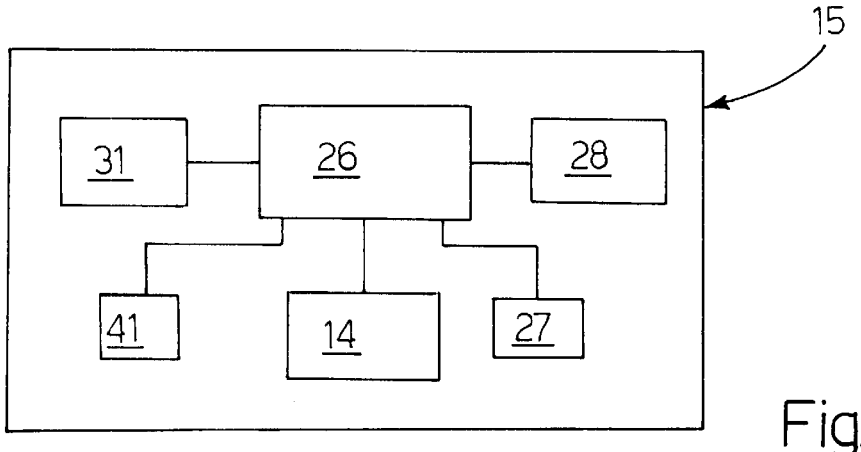
FIG. 2 shows a block diagram of an electronic central control unit fitted to the FIG. 1 machine.

With reference to FIG. 2, central control unit 15 comprises a central data processing unit 26; a data programming keyboard 27 to the side of display 14 (FIG. 3); and a memory block 28 for storing machine 1 operating data and programs.

Figure 3:
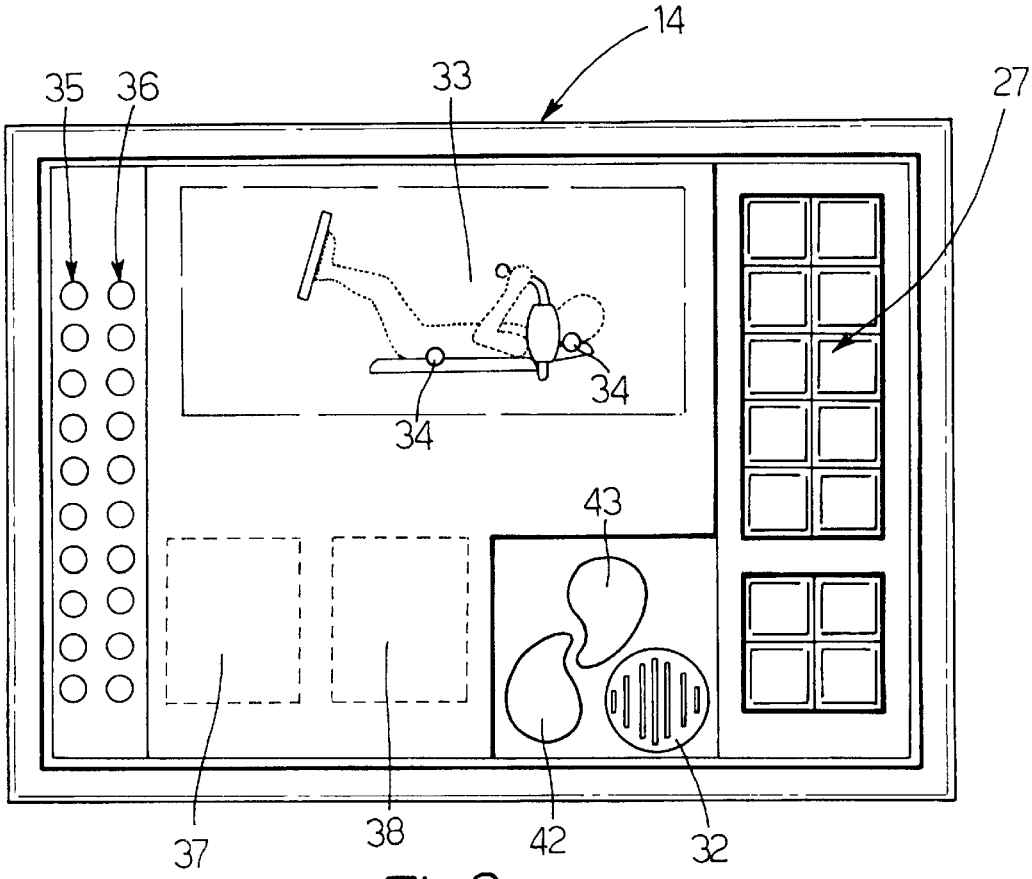
FIG. 3 shows the screen of a display device fitted to the FIG. 1 machine.

With reference to FIG. 1, correct-posture detecting means 4 comprise two sensors 31 located along supporting surface 3, e.g. a sensor 31 in the center of plate 6 and a sensor 31 at headrest 7, as shown in FIG. 1. Sensors 31 may be defined by respective microswitches, which, as long as they are pressed by the child's back and head, transmit respective electric signals to central control unit 15 to indicate the correct position of the child's back and head on supporting surface 3. If the position is incorrect, central control unit 15 obviously activates means 5, which provide for a wrong-position acoustic signal by means of an acoustic indicator 32 (FIG. 3), and for a visual indication 33 on display 14, which shows a child lying on supporting surface 3, and sensors 31 represented, for example, by a number of LED's 34 (FIG. 3). Failure of LED's 34 to light up indicates the corresponding microswitches 31 are not pressed and therefore that the corresponding parts of the child's body are not positioned correctly. It is also possible to determine the sequence in which microswitches 31 are pressed and hence the way in which the child's back and head are brought to rest on supporting surface 3, so as to indicate whether this is done correctly or incorrectly and so train the child not only to assume, but also how to assume, the correct final position.

With reference to FIG. 3, display 14 comprises two columns 35 and 36 of LED's. Column 35 comprises LED's of a first color and relates to a preset training program to be performed, while column 36 comprises LED's of a second color and relates to the training program currently being performed by the child. From keyboard 27, a specific training program can either be entered or selected from those already stored in memory block 28, according to the age, weight and other characteristics of the child. In actual use, the number of illuminated LED's in column 35 indicates how many repetitions, e.g. how many leg extensions, are to be performed within a predetermined period, while the number of illuminated LED's in column 36 indicates how many repetitions are actually performed by the child within the predetermined period. A training program may be defined by a sequence of repetitions to be performed within a predetermined period, and, to conform with the program, the child should try to repeat the same sequence with the aid of the LED signals in columns 35 and 36. To make the training program more entertaining, display 14 comprises a table 37 for assigning points according to the extent to which the displayed recommended training program is conformed with; and a window 38 showing a word of encouragement, which may also be pronounced by acoustic indicator 32.

Central control unit 15 may also operate a metronome 41 to help the child to perform the repetitions in a given sequence and within the programmed time.

Each training program is stopped when an incorrect position of the part of the child's body monitored by respective sensor 31 is detected. Display 14 comprises a first graphic symbol 42 with the word "STOP" and a second graphic symbol 43 with the word "START", both words being composed of LED's. "STOP" indicates the program has been stopped, and stays on until the body position has been corrected with the aid of LED's 34 showing which part of the body is not supported correctly on supporting surface 3. "START" stays on as long as the body position remains correct.

The advantages of the present invention will be clear from the foregoing description.

In particular, it provides for a machine enabling the child to perform physical exercises, but only when at least one part of the child's body is positioned correctly. Moreover, the child is informed at all times, both acoustically and visually, whether its body is positioned correctly or not, and also visually of which part of the body is not positioned correctly. It should be stressed that all these indications are given at any time during performance of the exercise and for any type of exercise, regardless of the type of exercise device being used.

Clearly, changes may be made to machine 1 as described and illustrated herein without, however, departing from the scope of the present invention.

In particular, the device supporting the part of the body may be defined by a vertical board defining a backrest, or by a tilted board. Sensors 31 may differ in number from those described, and may also detect the pressure exerted on them by the child's back, so as to determine the position of the child's back at various points and the distribution of high-pressure points. Also, machine 1 may be fitted with exercise devices other than those described and illustrated.

What is claimed is:

1. A posture training machine comprising:

a frame;

support means on said frame for supporting the head and the back of a user's body; said support means comprising at least two portions, a first portion which supports said head and a second portion which supports said back, said support means also comprising sensor means associated with said first and second portions for detecting the correct alignment, relative to one another, of said head and back on the respective portions of said support means; and exercise means on the frame for providing the user's body with exercise.

2. The machine as claimed in claim 1, comprising indicating means for indicating said correct alignment to a user.

3. The machine as claimed in claim 2, wherein said indicating means comprises an acoustic indicator.

4. The machine as claimed in claim 2, wherein said indicating means comprises a visual display of the correct alignment.

5. The machine as claimed in claim 4, wherein said indicating means comprises an electronic central control unit including a central data processing unit, a data programming keyboard, and a memory block for storing data and programs employed by said machine.

6. The machine as claimed in claim 5, wherein said indicating means comprises a training program and said visual display means comprises first means for displaying a training program set by the machine and second means for displaying a training program actually being performed by the user.

7. The machine as claimed in claim 6, wherein said central control unit comprises means for stopping the training programs when the respective body parts are incorrectly aligned; a first graphic symbol on said display to indicate a part of the body which in incorrectly aligned relative to another body part; and a second graphic symbol to indicate a part of the body that is correctly aligned with respect to another body part.

8. The machine as claimed in claim 4, wherein said support means includes a headrest and said display faces said headrest.

9. The machine as claimed in claim 8, comprising an arm extending between said support means and said display.

10. The machine as claimed in claim 5, comprising a metronome for marking time.

11. The machine as claimed in claim 1, wherein said support means is defined by a supporting surface lying in a horizontal plane.

12. The machine as claimed in claim 1, wherein said support means comprises a backrest lying selectively in a vertical plane or in a plane tilted with respect to a horizontal plane.

* * * * *